US009837062B2

(12) United States Patent
Wernick et al.

(10) Patent No.: US 9,837,062 B2
(45) Date of Patent: Dec. 5, 2017

(54) PERCUSSION INSTRUMENT AND SIGNAL PROCESSOR

(71) Applicant: Wernick Ltd., Leicester (GB)

(72) Inventors: William Melville Wernick, Leicestershire (GB); Rahul Guiris, Leicester (GB)

(73) Assignee: WERNICK LTD., Leicester (GB)

( * ) Notice: Subject to any disclaimer, the term of this patent is extended or adjusted under 35 U.S.C. 154(b) by 0 days.

(21) Appl. No.: 15/398,794

(22) Filed: Jan. 5, 2017

(65) Prior Publication Data

US 2017/0213535 A1 Jul. 27, 2017

(51) Int. Cl.

| | |
|---|---|
| ***G10H 3/14*** | (2006.01) |
| ***G10H 1/02*** | (2006.01) |
| ***G10H 1/14*** | (2006.01) |

(52) U.S. Cl.

CPC ..... *G10H 3/146* (2013.01); *G10H 1/02* (2013.01); *G10H 1/14* (2013.01); *G10H 3/143* (2013.01); *G10H 2250/025* (2013.01); *G10H 2250/435* (2013.01)

(58) Field of Classification Search

CPC ..... G10H 3/146; G10H 3/143; G10H 1/14; G10H 2250/025; G10H 2250/435

USPC ..... 84/627

See application file for complete search history.

(56) References Cited

U.S. PATENT DOCUMENTS 4,932,303 A * 6/1990 Kimpara ..... G10H 3/146 84/621
5,009,146 A * 4/1991 Manabe ..... G10H 1/055 84/615
5,223,654 A * 6/1993 Fujita ..... G10H 1/34 84/627

(Continued)

FOREIGN PATENT DOCUMENTS

EP 2975608 A2 1/2016
GB 2393316 A 3/2004

(Continued)

OTHER PUBLICATIONS

"Combined Search and Examination Report Under Section 17 and 18(3) for U.K. Patent Appl. No. GB1601426.8", Jun. 29, 2016, 8 Pages.

(Continued)

*Primary Examiner* — David Warren
*Assistant Examiner* — Christina Schreiber
(74) *Attorney, Agent, or Firm* — Medley, Behrens & Lewis, LLC

(57) ABSTRACT

The present invention relates to percussion instruments. In particular, it relates to a signal processor for detecting characteristics of vibration of a percussion pad due to a particular strike on the pad. It provides a musician more opportunity for creativity in the sound a listener a percussion instrument can hear. It provides a signal processor for a percussion instrument. The signal processor comprises a singular input signal acquiring means to acquire a singular input signal corresponding to a physical vibration of a (Continued)

percussion surface over time, a signal analyser to analyse the input signal for a characteristic of a strike on the surface which caused the vibration, and a command signal providing means to provide a command signal according to the characteristic.

12 Claims, 11 Drawing Sheets

(56) References Cited

U.S. PATENT DOCUMENTS 5,854,436 A * 12/1998 Wernick ..... G10H 3/146 84/411 P
5,856,628 A * 1/1999 Noguchi ..... G10H 3/146 84/421
6,601,436 B1 * 8/2003 Senda ..... G10H 3/146 73/12.09
8,831,762 B2 * 9/2014 Abe ..... G10H 1/16 700/94
9,240,173 B2 * 1/2016 Takasaki ..... G10H 3/146
9,672,802 B2 * 6/2017 Muzzio ..... G10H 3/146
2004/0083873 A1 * 5/2004 Yoshino ..... G10D 13/024 84/107
2004/0200338 A1 * 10/2004 Pangrle ..... G10H 3/06 84/724
2010/0326258 A1 * 12/2010 Masaki ..... G10H 1/16 84/730
2011/0085677 A1 * 4/2011 Walsh ..... H03G 9/005 381/94.3
2012/0024132 A1 * 2/2012 Wallace ..... G10D 13/024 84/689
2013/0180335 A1 * 7/2013 Susami ..... G01H 1/12 73/579
2013/0340598 A1 * 12/2013 Marquez ..... G10H 1/0558 84/730
2016/0093278 A1 * 3/2016 Esparza ..... G10H 3/143 84/615
2016/0140945 A1 * 5/2016 De Virgiliis ..... G10H 3/146 84/725
2016/0225361 A1 * 8/2016 Muzzio ..... G10H 3/146
2017/0213535 A1 * 7/2017 Wernick ..... G10H 3/143

FOREIGN PATENT DOCUMENTS

JP GB 2393316 A * 3/2004 ..... A63F 13/06
JP EP 2975608 A2 * 1/2016 ..... G10H 1/32

OTHER PUBLICATIONS

"Response to the Report Under Section 15A for U.K. Patent Application No. GB1601426.8", Filed Date: Jul. 24, 2017, 4 Pages.
"Report Under Section 15A for U.K. Patent Application No. GB1601426.8", dated Jun. 29, 2017, 2 Pages.

* cited by examiner

PERCUSSION INSTRUMENT AND SIGNAL PROCESSOR

CROSS-REFERENCE TO RELATED APPLICATION

This application claims the benefit of United Kingdom Patent Application No. GB1601426.8, filed on Jan. 26, 2016, and entitled "PERCUSSION INSTRUMENT AND SIGNAL PROCESSOR", the entirety of which is incorporated herein by reference.

FIELD OF THE INVENTION

The present invention relates to electronic percussion instruments. In particular, it relates to a signal processor for detecting characteristics of vibration of a percussion pad due to a particular strike on the pad.

BACKGROUND

In the prior art percussion instruments were devices which produced a sound upon striking a percussion instrument with a drum stick or mallet or hand. The sounds a person listening to the instrument were limited to the sounds produced by various vibrations of the percussion instrument itself.

This limitation was a drawback. The creative sounds a musician could achieve by striking the percussion instrument in various locations and with various sticks, mallets, or hands were limited to the different sounds the percussion instrument itself could produce. Also amplifying and/or recording these sounds in different venues could be problematic or expensive with sophisticated microphones.

Some percussion instruments are very difficult or impossible to transport so are limited to where they can be heard and seen by the listener.

This invention is directed to providing a musician more opportunity for creativity in the sound a listener a percussion instrument can hear.

SUMMARY

According to a first aspect of the invention there is provided a signal processor for a percussion instrument, comprising a singular input signal acquiring means to acquire a singular input signal corresponding to a physical vibration of a percussion surface over time, a signal analyser to analyse the input signal for a characteristic of a strike on the surface which caused the vibration, and a command signal providing means to provide a command signal according to the characteristic.

The present invention only employs a singular vibration sensor, used on nearly all electronic percussion surfaces, which can detect where on the surface the musician strikes the surface. With suitable sound generator one can for example recreate a true acoustic percussion instrument (e.g. ride cymbal) when activating and generating different sounds for different areas the electronic percussion instrument is hit. And with further processing the different areas of sensitivities on the percussion surface can be normalized for even sensitivity so as to make it easier for the musician to predict the volume purely on how hard he or she hits the surface. And unique sounds can be recorded and played depending on where on the percussion surface is struck.

Preferably the signal processor is arranged so that the command signal indicates an edge of the surface closest to the location of the strike.

Preferably the signal processor is arranged so that the command signal indicates a distance from a reference point of the surface to the strike.

Preferably the signal processor is arranged so that the command signal indicates an angle toward the strike with respect to a reference axis.

Preferably the signal processor comprises an extrema detector to determine the characteristic by whether the first occurrence of a trough or crest occurs before the first occurrence of a crest or trough respectively.

Preferably the signal processor comprises a ratio computer to determine the characteristic by the ratio of successive crests and/or troughs in the input signal.

Preferably the ratio computer is arranged to determine the characteristic from a plurality of the ratios.

Preferably the signal processor is arranged to analyse the characteristic to determine where on the surface the strike occurred from the order, values, and/or ratios of the troughs or crests.

Preferably the signal processor comprises an elapsed time detector to determine the characteristic by an interval between a troughs and/or a crest in the input signal, or between the start of the signal and a trough or crest.

Preferably the signal processor comprises a crest and/or trough counter to count peaks and/or troughs in the signal determine the characteristic.

Preferably the signal processor comprises a slope detector to determine the characteristic from a rate of change in the signal over time.

Preferably the signal processor is arranged to analyse the characteristic to determine a hardness of implement which made the strike, in particular where the characteristic is determined from the elapsed time between extrema such as peaks, troughs, and crests, the number extrema in a preselected time interval, or the rate of change time of the signal.

Preferably the signal processor comprises a signal energy determiner to determine an energy of the input signal to determine characteristic.

Preferably the signal processor is arranged to determine an intensity of impact of the strike from a characteristic determined from the energy of the input signal Preferably the signal processor comprises a means arranged to determine a second characteristic determined from analysis of the input signal.

Preferably the signal processor is arranged to analyse at least two characteristics to determine where on the surface the strike occurred, or a hardness of implement which made the strike.

Preferably the signal processor is arranged determine the intensity and/or location of a strike along the whole length of a rectangular percussion surface from analysis of a characteristic of the singular input signal.

Preferably the signal processor is arranged to determine the intensity and/or location of a strike on a circular percussion surface, from analysis of a characteristic of the singular input signal.

Sound produced by the physical vibration of the percussion surface is related to sound produced by a sound sampler and/or synthesizer on receipt of the command signal which enables a musician to create percussive or other sounds according to chosen a characteristic of a strike on the surface.

According to a second aspect of the invention there is an apparatus of a percussion instrument, comprising: the signal processor previously described and a vibration sensor arranged to detect vibration at a singular location on the percussion surface and provide the singular input signal to the singular input acquiring means.

Preferably the apparatus comprises only a single vibration sensor, wherein the vibration sensor is attached to the percussion surface at the singular location, such that there is only the signal vibration sensor arranged to sense vibrations on the percussion surface.

Advantageously the apparatus is a unit which may be included with new percussion instruments or retrofitted onto existing ones.

Preferably the vibration sensor is attached to the surface at the singular location. The vibration sensor can be attached to a recess in the surface if the surface has substantial thickness. Advantageously only a single vibration sensor is required.

From the singular input signal, the sensor provides, the characteristics described are obtained.

Preferably the vibration sensor comprises a piezo-electric crystal. Advantageously piezo-electric crystal sensors are sensitive to the frequency of vibration the percussion surface and have low mass so as to not interfere with the percussive sounds the musician wishes to play.

Preferably the percussion surface is rectangular and the piezoelectric sensor location is set at the centre of the longest dimension of the surface. Advantageously the location of the strike may be obtained by the characteristic.

Preferably the percussion surface is rectangular and the piezoelectric sensor location is offset from the centre of the longest dimension of the surface. Advantageously the location of the strike is proportional to the characteristic.

Preferably the percussion surface is circular, square, or rectangular and the sensor location is offset from the centre by a pre-selected distance. Preferably the distance of offset from the centre is in a range between 20% of the longest dimension and 30% of the longest dimension.

Preferably the percussion pad is circular and the piezoelectric sensor is located in the centre of the pad.

Preferably the apparatus comprises the percussion surface.

Every different position where the percussion surface is struck yields a different shaped signal or unique characteristic. How hard (intensity) of the strike also influences the shape or characteristic. In some embodiments a characteristic is accentuated by fixing a mass to the percussion pad or by removing some mass surface if it has significant thickness e.g. wooden bar.

Preferably the vibration sensor is located at the center of the percussion surface. Advantageously this location is generally the most sensitive region to give the best signal to noise ratio for the sensor. In alternative embodiments the sensor is fixed a distance from the centre to accentuate a preselected characteristic.

Preferably the signal processor is arranged to analyses the first 2-3 milliseconds (sample length) of the input signal. Advantageously signal processor is arranged to detect the characteristic and to send the output command signal a short time after this time interval.

Preferably the signal processor is in communication with a memory unit to store a set of sample values at even intervals of time (for example every 20 micro seconds) throughout the singular input signal length (preferably 2-3 milliseconds). Preferably the signal processor is configured to generate a digital 'fingerprint' of the input signal from which a signal characteristic is obtained by the signal analyser.

The signal analyser is configured to use a set of samples and produce meaningful data such as peak values. The definition of 'peak' to include crests and troughs and local crests and local troughs and calculated by, for example, a few successive sample values changing from increasing to decreasing in value or vice versa.

Preferably the signal analyser filters the signal input signal, to reduce noise disturbances and mathematical errors due to the analogue to digital conversion resolution and sample interval.

Preferably the signal analyser is arranged to operate on a peak value relative to a reference axis being a stable reference voltage or ground plane or the value when there is no signal from a percussion surface hit.

Preferably a threshold is set by the signal analyser according to noise levels.

Preferably the signal analyser is arranged to determine when the peaks in the singular input signal occur relative to the start of the signal as well as when the signal crosses the reference axis and the last sample value (at the end of the sample length).

Preferably the signal processor is configured to determine whether successive peaks are greater or smaller in magnitude for further determination as well as ratios of successive peak values and gradient of the rise or fall of the signal.

Preferably the signal processor is configured to determine the number of peaks in the sample length.

Preferably the signal processor is configured to determine whether there is a plateau (a substantial group of samples without significant rise or fall in value).

Preferably the signal processor is configured to determine the number of plateaus in the sample length.

This and all the above calculated results are referred to as the 'attribute set'.

Preferably the signal processor is arranged to ascertain whether the start of the signal has a positive or negative slope to determine which area the pad was struck relative to the sensor position.

Preferably the signal analyser is configured to calculate the energy of a strike because the initial positive or negative slope can change depending on the energy of a hit in a particular region on the percussion surface.

Preferably the signal processor comprises a ratio computer with which the signal analyser is arranged to determine the characteristic by the ratio of successive crests and/or troughs in the input signal, whereby the command signal is provided such that it is indicative of the location of the strike on the surface.

Advantageously strikes by the musician in preselected regions of the surface are enhanced by commanded production of sampled and/or synthesized sounds having a preselected volume, pitch, or tonal quality according to the desire of the musician who may select the characteristic.

Preferably the command signal which the command signal providing means provides indicates the location by a length from the center of the percussion surface, such that the length is dependent to the ratio.

For a percussion surface which is rectangular, the volume, pitch, or tonal quality of the sound produced by the sound sampler and/or synthesizer varies according to where along the length of the surface it is struck. For a percussion surface which is circular, the volume, pitch, or tonal quality of the sound produced by the sound synthesizer varies according to the distance from the center. If preferred, volume, pitch, or tonal quality of the sound produced by the sound synthesizer varies according to the direction relative to a reference axis the surface is struck. If preferred, volume, pitch, or tonal quality of the sound produced by the sound synthesizer varies according to the distance from the centre and direction relative to a reference axis the surface is struck.

Preferably the signal processor comprises an extrema detector with which the signal analyser is arranged to determine the characteristic by whether the first occurrence of a trough occurs before the first occurrence of a crest in the singular input signal, and whereby the command signal is provided such that it is indicative of whether the strike was proximate the edge.

Ideally the signal analyser is configured to search for two or more characteristics in succession. Preferably the first one of characteristics the signal analyser is arranged to find is a characteristic indicative of how hard the surface was struck.

Preferably the second one of characteristics the signal analyser is arranged to find is a characteristic indicative of where the surface was struck.

Preferably the signal analyser is arranged to search for a characteristic providing a quantitative indication of how hard the surface was struck and then use the quantitative indication to interpret a characteristic of where the surface was struck.

In one embodiment the signal analyser is arranged to estimate the intensity from a root mean square of values of the singular input signal. In another embodiment the signal analyser is arranged to estimate the intensity of the strike from an average or summation of the absolute values of data samples of the singular input signal. In another embodiment the signal processor sums the magnitude of selected or all crests and troughs in the input signal to obtain a measure of the intensity of the strike.

In one embodiment the signal analyser is arranged to make use of artificial neural networks to determine characteristics for different input signals correlating to hardness of implement used, position and intensity of hit on percussion surface.

In one embodiment the signal analyser is arranged to make use of FFT (fast Fourier transform) and wavelet technology to determine characteristics for different input signals correlating to hardness of implement used and position of hit on percussion surface.

Preferably the signal analyser is configured to make an estimation of how hard the surface was struck by estimating or calculating the energy of the singular input signal or a peak or trough of the singular input signal.

Preferably the signal analyser is configured to choose pre-selected crests and/or troughs from the singular input signal to determine a characteristic. Preferably the pre-selected crests and/or troughs which are chosen are determined by the estimation of how hard the surface was struck. Advantageously the location of where the surface was hit is determinable from a characteristic which is a ratio of the chosen pre-selected crests and/or troughs. Preferably the signal analyser is arranged to determine the ratio.

Advantageously strikes by the musician are enhanced by commanded production of sampled and/or synthesized sounds. Advantageously the sounds are enhanced according to the proximity of the strike to the edge of the percussion surface. Preferably the commands are for a volume, pitch, or tonal quality according to the desire of the musician who may select the characteristic.

Preferably the signal processor comprises an elapsed time detector to determine the characteristic by detecting how much time elapses between a first occurrence of a reference feature and a subsequent occurrence of a reference feature in the input signal so that the elapsed time correlates to a period of vibration of the surface, and provide the command signal such that it is indicative of the hardness of an instrument (for example hand mallet or drumstick) used to provide the strike on the surface.

Advantageously strikes by a hand, mallet or drumstick having a hardness selectable by the musician who strikes the instrument are enhanced by commanded production of sampled and/or synthesized sounds having a preselected volume, pitch, or tonal quality according to the desire of the musician who may select the characteristic.

Preferably the signal analyser is arranged to determine when the input signal crosses a reference axis for determining the characteristic. Preferably this is a neutral axis or x-axis or an axis of time. Preferably signal processor is arranged to use this characteristic to provide an indication of the hardness of the instrument used to provide the strike.

Preferably the signal processor comprises a plurality of signal processors in a single device, wherein the command signal providing means is arranged to utilize the characteristic provided by each signal analyser and provide a plurality of command output signals.

Advantageously a musician who plays a drum set having a plurality of drums each with an individual percussion surface may produce sampled and/or synthesized sounds according to the selection of the characteristic for each drum individually.

Advantageously a musician who plays a Marimba, Vibraphone or xylophone having a plurality of percussion pads each with an individual percussion surface may produce sampled and/or synthesized sounds according to the selection of the characteristic for each percussion pad individually.

Preferably the signal processor comprises a signal transformer to transform the command output signal(s) and transform them into a format whereby a sound corresponding to the strike on the surface may be produced a by musical instrument which accepts commands in the format. Preferably the signal processor according to any preceding claim, is arranged to receive user input and provide the command output signal(s) in a user specified format.

Advantageously the transformer may transform the command output signal(s) to have an industry standard format such a 'MIDI' which accepted by sound samplers and/or synthesizers. Advantageously the user who may be the musician provide input to the signal processor so the sound produced by a sound sampler and/or synthesizer is according to their own musical creativity.

Optionally the volume of the sound produced is dependent on the location of the strike.

The invention will now be described, by way of example only, with reference to the accompanying drawings in which:

DETAILED DESCRIPTION

Figure 1:
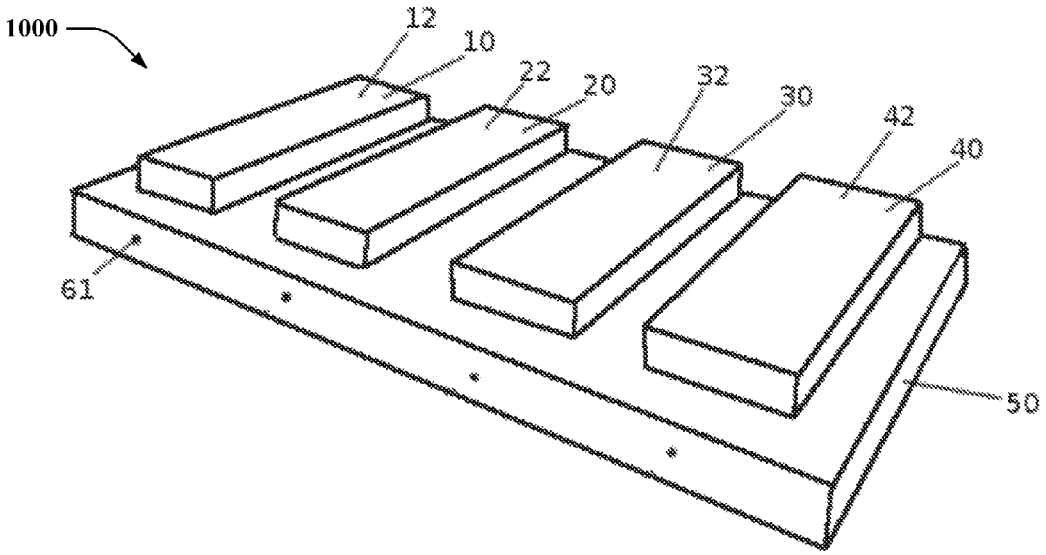
FIG. 1 shows an isometric view of a percussion instrument comprising an apparatus with signal processor.
Figure 2:
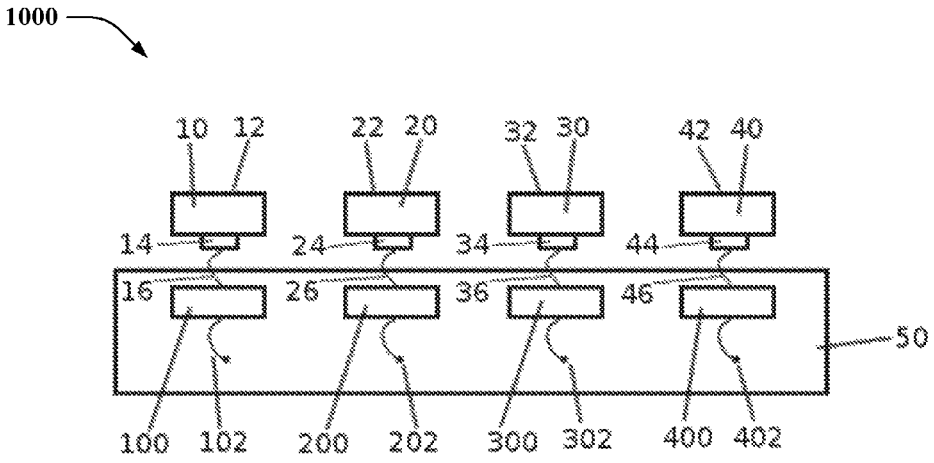
FIG. 2 shows an elevation view of a percussion instrument comprising an apparatus with a signal processor.

In FIG. 1 and in FIG. 2 an isometric view and an elevation view of a percussion instrument 1000 are shown. The percussion instrument comprises four percussion pads 10, 20, 30, and 40. Each percussion pad is supported on a pad support 50. Each percussion pad has a top surface which is a percussion surface 12, 22, 32, and 42. Typically a hand held mallet or drumstick is used to strike the percussion surface to produce sound.

As shown in FIG. 2, a single vibration sensor 14, 24, 34, and 44 is fixed to each one of the percussion pads 10, 20, 30, 40. In FIG. 2, each sensor is fixed to the bottom of the percussion pad. In the embodiments, not shown, the vibration sensor is contained in a recess in the percussion pad. In other embodiments vibration sensor 14 is attached directly to the percussion surface 12.

An electrical wire 16 connects the vibration sensor 14 to the signal processor 100. Likewise, there is an electrical wire 26, 36, 46 which connects each of the vibration sensors 24, 34, 44 to each of the signal processors 200, 300, 400.

A singular input signal is carried by the electrical wire 16. The singular input signal corresponds to the vibration of the percussion surface detected by the vibration sensor 14. Typically, the singular input signal is a voltage and/or current which oscillates over time according the vibration.

The signal processor 100 comprises a singular input acquiring means which is connected to the electrical wire 16. The signal processor 100 acquires the singular input signal through the electrical wire 16.

The signal processor is arranged to analyse the singular input signal. The singular input signal is similar to a fingerprint or a signature in that it has a characteristic or characteristics which provide a clue to its origin. The signal processor comprises a signal analyser arranged to identify the characteristic.

The signal processor comprises a command signal providing means. A command signal wire connects the signal processor 100 to an electrical contact 102. A command signal from the command signal providing means is provided to the electrical contact via the command signal wire. Likewise, there is an electrical wire which connects each signal processor 200, 300, 400 to electrical contacts 202, 302, 402 respectively.

Figure 3:
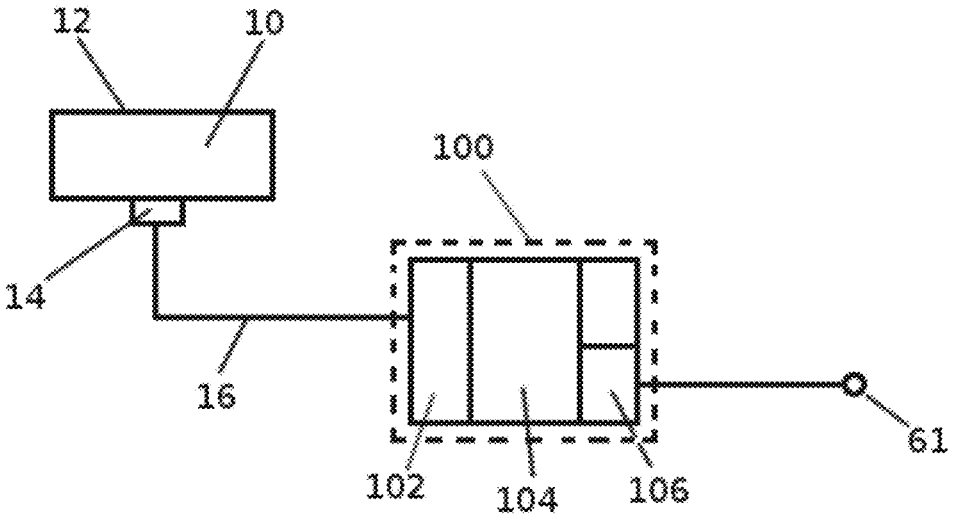
FIG. 3 shows a schematic of an apparatus for a percussion instrument comprising a signal processor and a vibration sensor fixed to a surface of a percussion pad.

A schematic of an apparatus for a percussion instrument is shown in FIG. 3. The apparatus comprises signal processor 100 and vibration sensor 14. An electrical wire 16 connects the signal processor 100 to the vibration sensor 14.

In FIG. 3 the vibration sensor is shown attached to the bottom of a percussion pad. The pad is a skin such a drum skin, or is a relatively thick metal plate such a Vibraphone plate, or it is a wooden block.

The signal processor 100 comprises singular input signal acquiring means 102. A vibration signal provided by the vibration sensor is acquired through the electrical wire 16 by the signal acquiring means.

The signal processor 100 comprises signal analyser 104. Subsequent to be acquired singular input signal analyzing means, the vibration signal is passed to signal analyser 104.

The signal analyser 104 analyses the signal for a characteristic. In an embodiment the signal analyser is arranged to determine a characteristic of the vibration signal from a preselected variation of the vibration signal over time.

The signal processor 100 comprises a command signal providing means 106. Subsequent to determining the characteristic, information about the vibration of the percussion pad determinable from the characteristic is passed to command signal providing means. Typically, the information identifies the type of characteristic and includes a quantitative value which defines or describes the characteristic.

The command signal providing means 106 is arranged to provide the information in the form of a command signal about the vibration of the percussion pad according the characteristic. Typically, the command signal is suitable to command a sound synthesizer to produce a particular sound specific to the characteristic. Typically, the command signal includes information that identifies the type of sound to be produced or the volume of the sound or both. The command signal is typically provided by a wire to a contact 61 for the sound sampler or synthesizer. However, the command signal providing means in some embodiments comprises a wireless transmitter to transmit the command signal to a sound sampler or synthesizer.

In an embodiment the command signal providing means is arranged to receive information from the signal analyser in a digital form and output the command signal in a digital form. In another embodiment the command signal providing means provides the command signal as an analog or quasi-analog signal which may be amplified directly and provided to a speaker to produce a sound according to the characteristic of the singular input signal.

Figure 4:
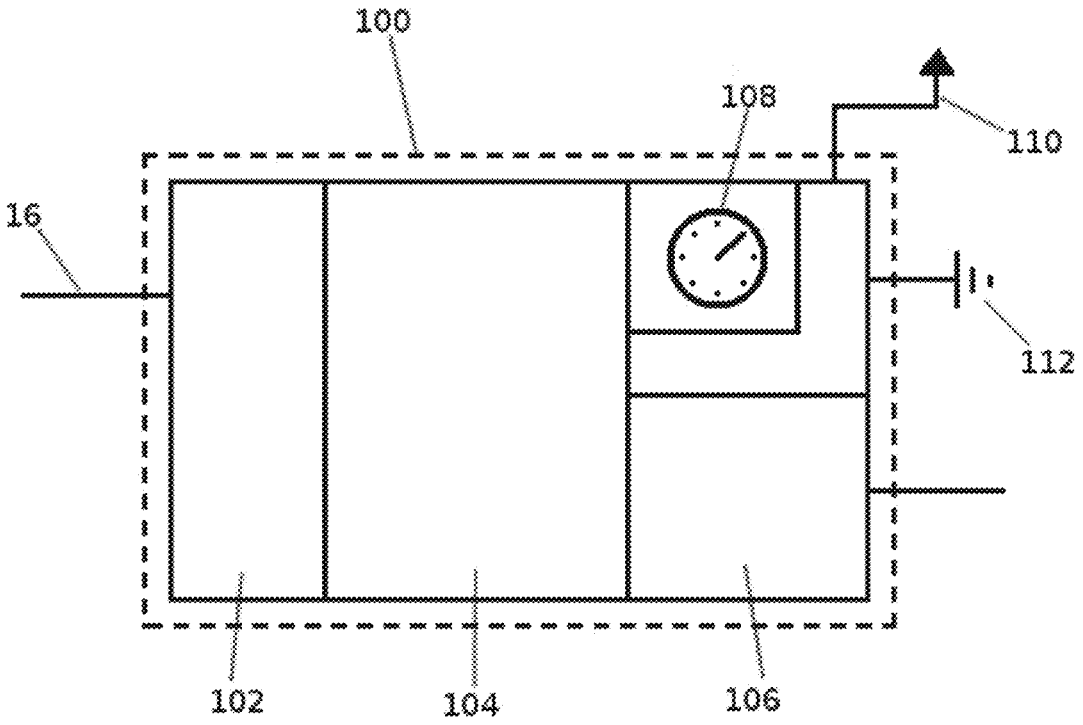
FIG. 4 shows a schematic of a signal processor for a percussion instrument.

FIG. 4 shows further detail of the signal processor 100. The signal processor analyses the singular input signal and responds upon encountering a peak, a crest, a trough, an average value, a reference value, a rate of change in the value of the input signal over time, a summation of the input signal time, and/or another property of the signal. The signal processor generates a command signal as the response analyzing the singular input signal.

In an embodiment the signal processor 100 comprises analogue circuit elements. These elements are arranged to operate directly on a singular input signal which is an analogue signal.

In another embodiment the signal processor 100 comprises digital circuit elements. These digital elements are arranged to operate directly on a singular input signal which is a digital signal. These elements are also arranged to sample an analogue singular input signal and convert it to a digital signal.

In an embodiment the signal processor comprises an electronic clock 108. In an embodiment the clock is arranged determine the start time of a property of the signal, the end time, or the elapsed time of a property in the signal.

The signal processor is arranged to be connected to a power supply 110, and also to a ground 112. The apparatus of the percussion instrument shown in FIG. 4 comprises a terminal or jack for connecting to the power supply 110 and the ground.

Figure 5:
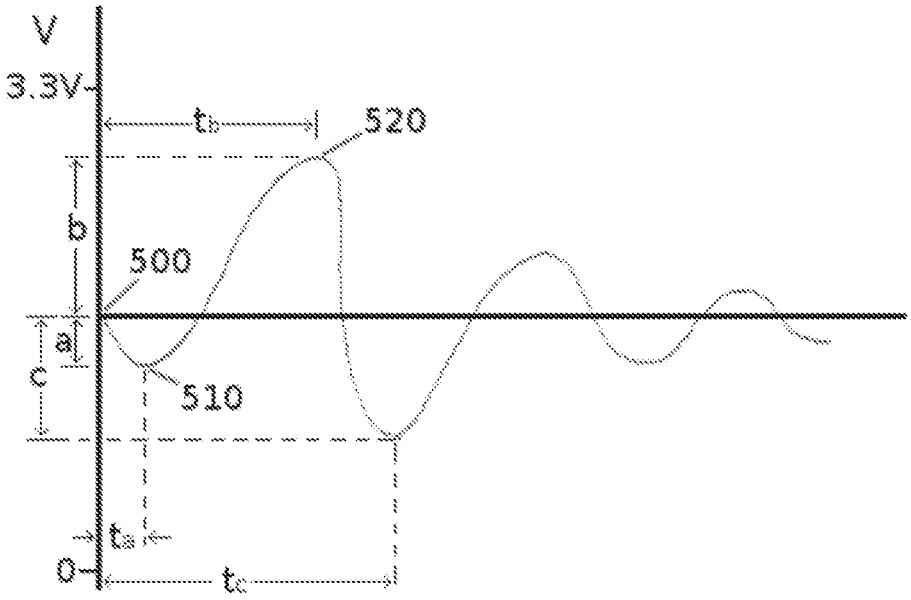
FIG. 5 shows a plot of a singular input signal provided by a vibration sensor over time of a percussion pad upon being struck proximate an edge of a vibration surface.

FIG. 5 shows a portion of a singular signal input over time. The signal is an analogue time varying voltage or current provided by the vibration sensor 14 to the singular input signal acquiring means 102 via electrical wire 16. The singular input signal is produced by a vibration sensor 14 which is located on the bottom the pad at the center of the pad.

In another embodiment the singular input acquiring means is arranged to receive a digital singular input signal. The digital singular input signal is not shown in FIG. 5.

The portion of the singular input signal shown in FIG. 5 is for time immediately following striking the percussion pad 10 at an edge of percussion surface 12.

The singular input signal start point 500 is simultaneous with a strike against the surface 12 of the percussion pad 10.

The singular input signal due to striking the percussion pad lightly or of a medium intensity near the edge has a characteristic. The characteristic is a minor trough 510. The minor trough 510 occurs subsequent to the strike. There is no earlier crest or trough in singular input signal intermediate the strike 500 or the minor trough 510.

The magnitude of the minor trough 510 less than one seventh of the magnitude of the subsequent crest 520 in the singular input signal. The signal analyser is arranged to analyse the singular input signal and detect the minor trough 510.

Information is transferred from the signal analyser to the command signal providing means. The information identifies the characteristic as the type produced by striking the percussion pad 10 at the edge of the percussion surface 12 for light and medium intensity hits.

The signal analyser is arranged to detect the minor trough 510. If the polarity of the singular input signal is provided in reverse by the vibration sensor 14, the minor trough 510 is reversed to be a minor crest. The subsequent crest 520 is reversed to be a subsequent trough. The magnitude of the minor crest is less than one seventh the magnitude of the subsequent trough. However other regions on the pad surface may yield a similar condition and a minor crest or minor trough maybe used as a determining characteristic to distinguish between the two regions. Therefore it is preferable the vibration sensor be wired in one orientation to give the correct polarity or a test condition whereby the system asks for a user to preferably hit a specific area on the pad surface of preferably light or medium intensity to determine the polarity of the vibration sensor wires. Determining the polarity will then, if required, reverse polarity of all future input signals associated with the particular pad surface.

In an embodiment the command signal providing means is arranged to provide a command which can be interpreted by a sound sampler or synthesizer to produce a sound having a preselected volume. The input signal for a light medium and hard intensity hit near the edge of a percussion surface is smaller in magnitudes compared to the centre due to the natural modes of vibration of the percussion pad amongst other factors. This apparent difference in sensitivity can be conditioned or eliminated with a scaling factor, determined by when the signal analyser detects a minor trough 510, multiplied by the energy value. In another embodiment the command signal providing means is arranged to provide another or additional command which can be interpreted by a sound sampler or synthesizer to produce a sound having a preselected tonal quality including preselected frequencies and volumes which vary over time.

Figure 6:
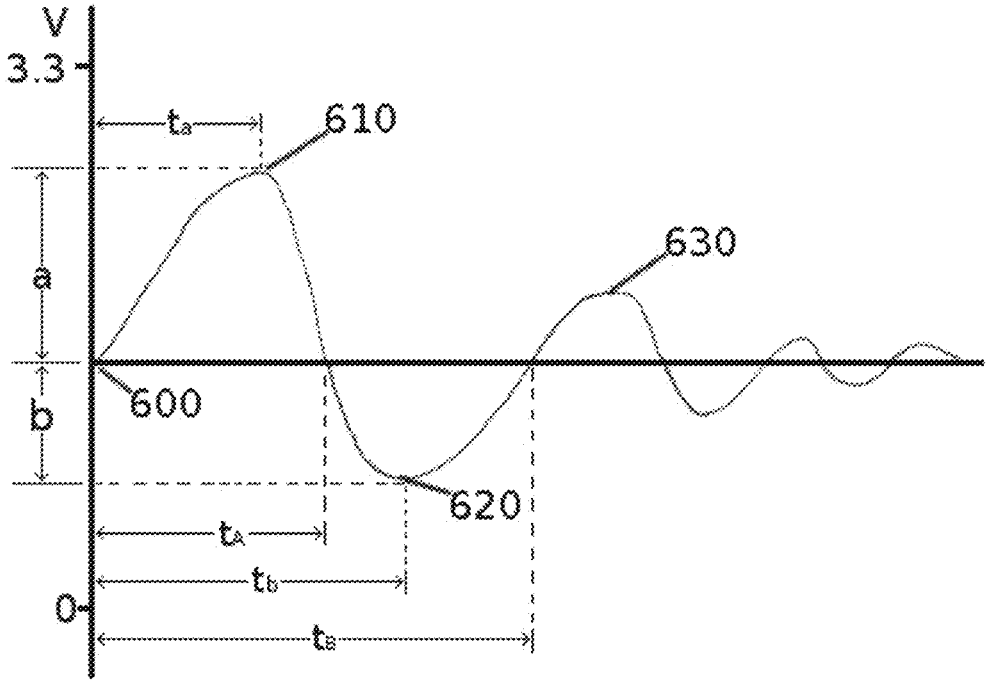
FIG. 6 shows a plot of a singular input signal provided by a vibration sensor over time of a percussion pad upon being struck in the central region of a vibration surface.

FIG. 6 shows a plot of a singular input signal provided by a vibration sensor over time of a percussion pad upon being struck in the central region of a vibration surface 12 of a percussion pad 10.

The singular input signal shown is FIG. 6 was provided by a vibration sensor 14 located on the bottom of a percussion pad and at or near the central area of the bottom of the percussion pad 10.

In the plot of the singular input signal shown in FIG. 6 there is no minor trough or minor crest before the first occurrence of a trough or crest having a larger magnitude. FIG. 6 illustrates that a strike 600 on the central region does not produce such a minor trough or a minor crest in the singular input signal.

The signal analyser 100 is arranged to detect the first and second occurrence of a crest and a trough in the singular input signal. The signal analyser 100 is arranged to detect that the magnitude of the first occurrence of a crest or a trough is greater than the magnitude of its subsequent peak or trough. The signal processor is arranged to detect that the first occurrence of a crest or trough subsequent to the strike is not a minor peak or minor trough having a magnitude of a seventh or less than the magnitude of the subsequent peak or trough. The signal analyser 100 is arranged to deduce from the absence of the minor peak or trough that the strike on the percussion surface 12 was not proximate the edge of a rectangular pad or not central to a round pad percussion surface. Consequently, the signal analyser provides information to the command signal providing means that the percussion surface was not struck proximate the edge of a rectangular pad or not central to a round pad.

The signal analyser is arranged to provide information to the command signal providing means 106 which indicates that the strike which caused the singular input signal was located in the central region of the percussion surface 10.

The relative magnitude of the first crest 610 and the relative magnitude of the subsequent trough 620 define a ratio. The signal analyser is arranged detect the first crest 610 and subsequent trough 620. The signal analyser is arranged to determine the ratio. From the ratio the signal analyser is arranged to determine the location of the strike on the percussion surface 12 which produced the singular input signal. The ratio is characteristic of the singular input signal which indicates the location of the strike. The ratio of the trough 620 and subsequent crest 630 can be used in the same way to produce a ratio for determining the location of the strike.

If the polarity of the singular input signal is provided in reverse by the vibration sensor 14 the signal becomes mirrored about the neutral axis so crests 610 and 630 become troughs and trough 620 becomes a crest. This will polarity change will not alter the ratio. However the polarity of the initial peak 610 (whether a crest or trough) maybe used as a determining characteristic to distinguish between two regions on the pad surface with similar responses.

Therefore it is preferable the vibration sensor be wired in one orientation to give the correct polarity or a test condition whereby the system asks for a user to preferably hit a specific area on the pad surface of preferably light or medium intensity to determine the polarity of the vibration sensor wires. Determining the polarity will then, if required, reverse polarity of all future input signals associated with the particular pad surface.

In an embodiment where percussion pad 10 is rectangular and the vibration sensor is located at center of the bottom of the pad. The rectangular percussion surface 12 has a length which is the longest dimension of the percussion pad 10. The ratio of the first crest 610 and subsequent trough 620 is a characteristic which indicates the location along in the length where the strike on the percussion surface 12 occurred.

The ratio is characteristic of the location because the magnitude of each subsequent crest or trough is less or more than the magnitude of the previous crest or trough by an amount that is governed by the location of the strike along the length. It is preferable to select a ratio of peaks that do not determine two regions or positions for a particular ratio i.e. the ratios need to increase or decrease but ideally not both along the length. If the ratio does increase and decrease or vice versa along the length it is preferable to use another determining characteristic to distinguish between the conflicting positions where the first characteristic was unable to distinguish.

The signal analyser is arranged to provide information to the command signal providing means 106 which indicates that the strike which caused the singular input signal was located at a location on the percussion surface 10 according to the ratio determined by the characteristic.

The signal processor 100 comprises a timer 108 for use as an elapsed time detector. The elapsed time from the occurrence of the first trough to the first crest is a characteristic of the singular input signal. The characteristic indicates the hardness of an instrument used for the strike which produced the singular input signal.

The signal analyser is arranged to provide information to the command signal providing means 106 which indicates the hardness of an implement used to strike the surface according to the ratio determined by the characteristic.

The signal analyser is arranged to determine the characteristic of the location of the strike or the hardness of the implement in a case where the polarity of the command signal is reversed.

Figure 7:
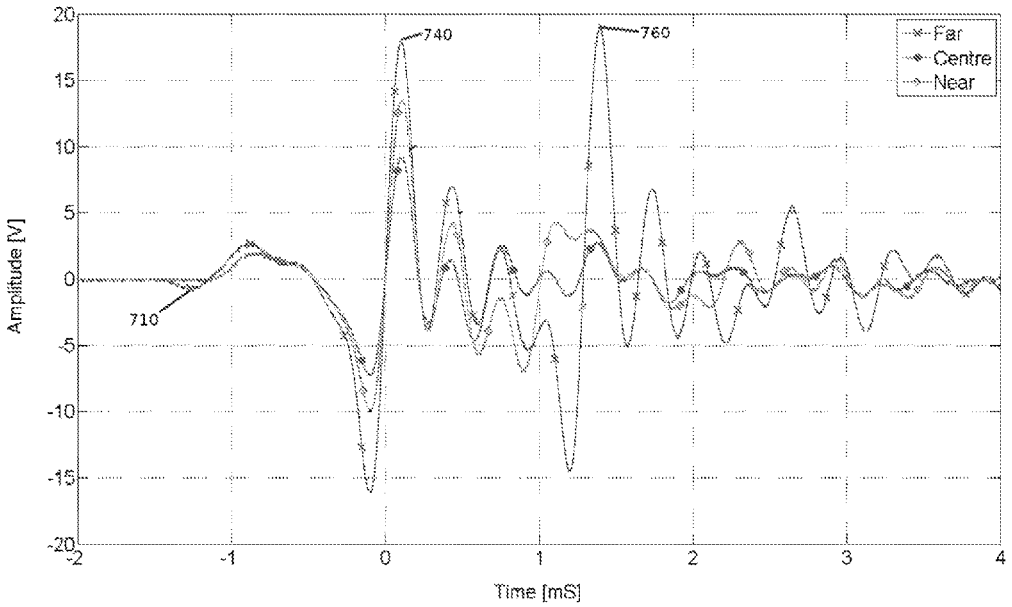
FIG. 7 shows 3 different singular input signals corresponding to a physical vibration of a surface of a rectangular percussion pad over time.

FIG. 7 shows a plot of three different singular input signals over a time interval of several milliseconds. These plots are actual experimental data recorded upon striking the rectangular percussion pad 10 shown in FIG. 8 and FIG. 9.

Figure 8:
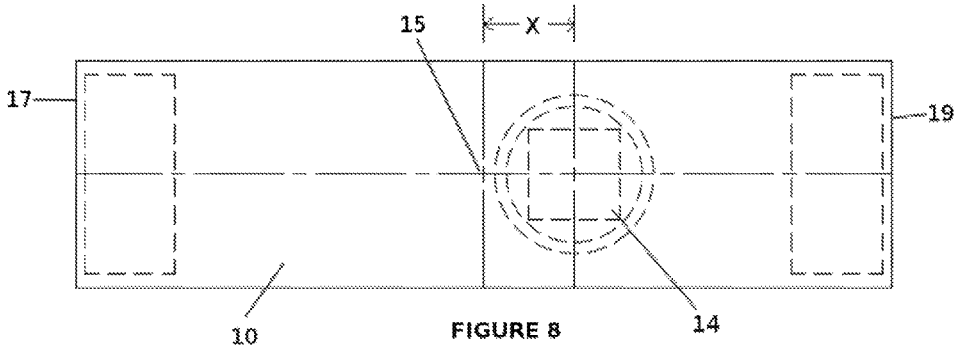
FIG. 8 shows a top view the rectangular percussion pad which was struck to produce the 3 different singular inputs of FIG. 7.
Figure 9:
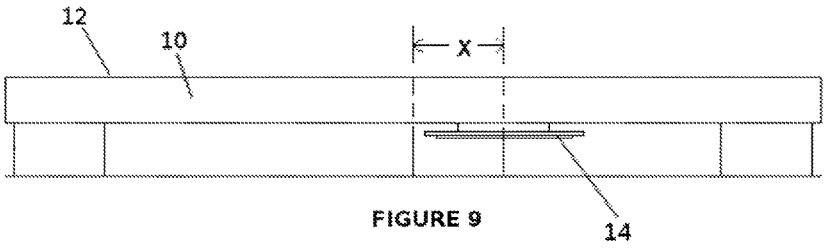
FIG. 9 shows an elevation view of the rectangular percussion pad which was struck to produce the 3 different singular inputs of FIG. 7.

The percussion pad shown in FIGS. 8 and 9 is made from birch plywood. The length is 371 mm, the width is 64 mm and the thickness is 9 mm. A piezo-electric vibration sensor 14 is attached to the bottom of the percussion pad. The vibration sensor is located mid-width and is offset from the center of the longest dimension by the offset distance shown as 'X'. The offset distance X is 85 mm.

Three strikes of equal intensity were struck against the percussion surface 12 to produce the three singular input plots shown in FIG. 7. The same striking instrument was used for each strike.

One of the singular input signals shown in FIG. 7, which is shown by trace 700, is due to a strike proximate the distal edge 17 of the percussion surface 12 shown in FIG. 8. Edge 17 is the farthest edge of the length dimension from the sensor 14.

Immediately after the strike, the singular input signal 700 has a minor trough 710 unlike the other traces but also has a striking resonance around 800 Hz which is marked by peaks 740 and 760 and the period between them. This trace shows that it is preferable to have a signal analyser taking 3 milliseconds of signal data to capture peak 760 to determine which side of the vibration sensor the percussion pad is hit.

One of the singular input signals shown in FIG. 7, which is shown by trace 800, is due to a strike at the center 15 of the percussion surface 12 shown in FIG. 8.

Immediately after the strike, the singular input signal 800 does not have minor trough which indicates the percussion surface was not struck near edge.

One of the singular input signals shown in FIG. 7, which is shown by trace 900, is due to a strike at the proximate edge 19 of the percussion surface 12 shown in FIG. 8.

Figure 10:
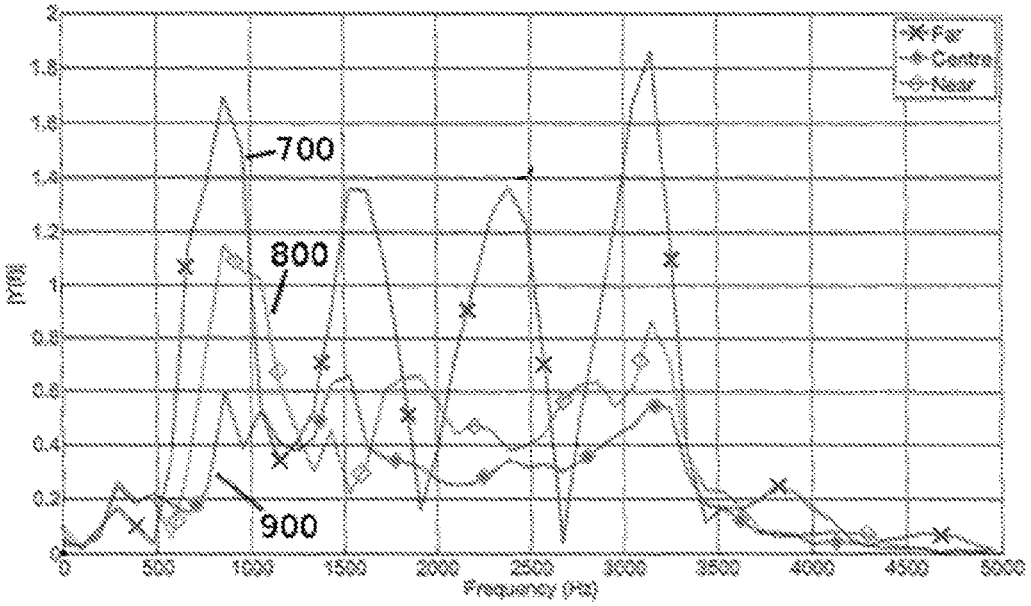
FIG. 10 shows a fast Fourier transform of each of the three singular input signals shown in FIG. 7.

FIG. 10 shows an FFT (fast Fourier transform) of the three singular input signals shown in FIG. 7. In an embodiment the signal analyser is arranged to determine a characteristic of each the singular input signal from the frequencies and relative amplitudes of a strike response to calculate the position. Refining techniques such as Wavelet Transforms could improve speeds by narrowing the frequency band widths and sample times.

In another embodiment the signal processor comprises a memory module. The signal analyser is arranged such that when the percussion surface is struck the signal characteristic is stored in the memory module. The signal processor also stores relevant information for the characteristic such as the location of the strike on the percussion surface. Subsequently when the percussion surface is struck in that particular location with the same intensity then the processor will recognize the characteristic and send a command signal including the relevant information via the command signal providing means.

Figure 11:
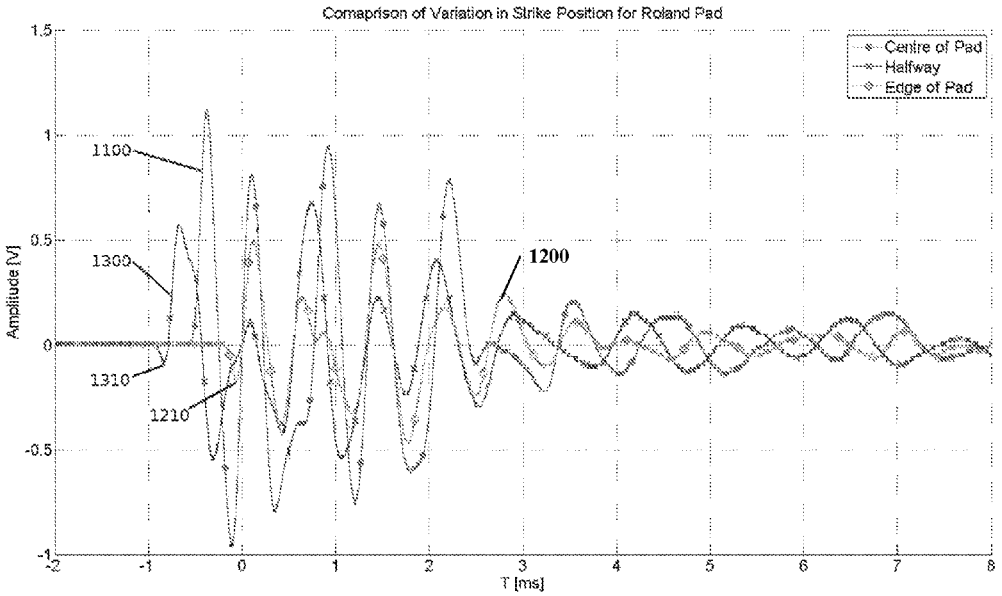
FIG. 11 shows 3 different singular input signals corresponding to a physical vibration of a surface of a circular percussion pad over time.

FIG. 11 shows 3 different singular input signals corresponding to a physical vibration of a surface of a circular percussion pad over time. The percussion pad is 'Roland PD8 Pad'. Traces 1100, 1200, and 1300 show the singular signal input signal due to a strike on the center, halfway from the center to the edge, and at the edge of the percussion surface of the pad.

A minor trough 1210 in the singular input signal due to striking the circular pad at the edge of the percussion surface is evident.

A minor trough 1310 in the singular input signal due to striking the circular pad halfway between the edge of the percussion surface and the center of the surface is evident.

The magnitude of the minor trough 1210 in the singular input due to the strike on the edge is larger than the magnitude of the minor trough 1310 due to the strike halfway between the edge and center. There is no minor trough in the singular input signal due to a strike at the center. A larger magnitude minor trough indicates than another indicates that singular signal input with the minor trough of larger magnitude is associated with the singular input signal due to a strike closer to the edge.

Practical examples of the utility of the invention are demonstrated with test data. A 'Roland PD8' percussion pad was used for the tests. It was a circular percussion pad which had a percussion surface with a diameter of approximately 200 mm. A vibration sensor which had a 35 mm diameter piezo element was fixed to the center of the surface. A 1000-ohm resistor was electrically connected across the piezo element. A drumstick with wood tip was used to strike the surface.

The test data is shown in Table 1, Table 2, and Table 3 below.

TABLE 1

Figure 13:
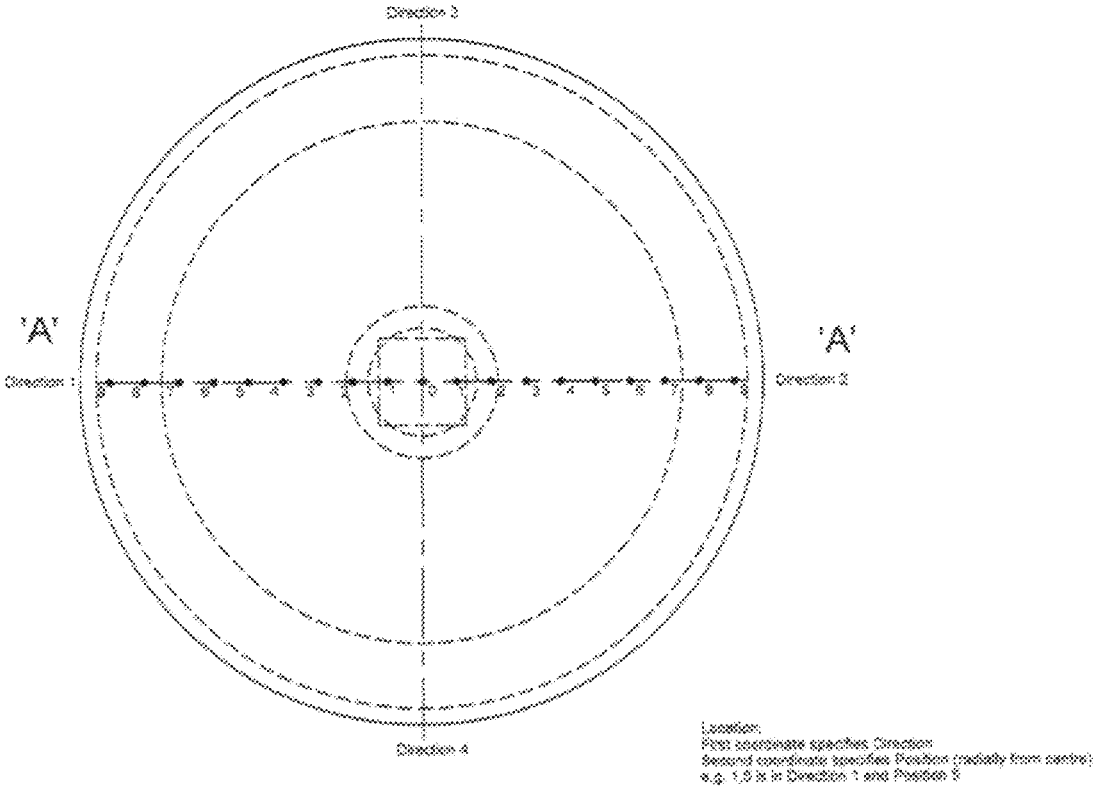
FIG. 13 shows the locations on a circular percussion surface where the wooden tip of the drumstick struck to produce the singular input signals of FIG. 12.

Test results of soft strikes on circular pad, where strike locations range from the pad surface center to pad surface edge in Direction 1 as shown in FIG. 13.

| Light Hit (61 mm free fall from Pad Surface) | | | Test c | Peak | Peak | Peak | Peak | Peak | Standard Deviation | Standard Deviation | Standard Deviation |
|---|---|---|---|---|---|---|---|---|---|---|---|
| Direction 2 mm | Strike Position From Centre | Energy | Peak 1 Value | 2 Value | 3 Value | 2/1 Ratio | 3/2 Ratio | 3/1 Ratio | Peak 2/1 Ratio | Peak 3/2 Ratio | Peak 3/1 Ratio |
| 0 | 0 | 48.2 | −139.4 | 85.2 | −104.5 | 0.61 | 1.23 | 0.75 | 0.01 | 0.08 | 0.05 |
| 10 | 1 | 48.4 | −132.3 | 99.4 | −99.5 | 0.75 | 1.00 | 0.75 | 0.03 | 0.05 | 0.03 |
| 20 | 2 | 39.6 | −110.9 | 68.8 | −62.4 | 0.62 | 0.91 | 0.56 | 0.02 | 0.02 | 0.02 |
| 30 | 3 | 29.6 | −89.5 | 19.5 | −16.8 | 0.22 | 0.86 | 0.19 | 0.02 | 0.01 | 0.01 |
| 40 | 4 | 25.3 | 3.8 | −72.5 | 33.7 | 19.08 | 0.46 | 8.87 | 0.32 | 0.01 | 0.12 |
| 50 | 5 | 27.8 | 8.8 | −71.2 | 55.1 | 8.09 | 0.77 | 6.26 | 0.27 | 0.02 | 0.20 |
| 60 | 6 | 22.5 | 15.8 | −69.1 | 48.6 | 4.37 | 0.70 | 3.08 | 0.29 | 0.01 | 0.24 |
| 70 | 7 | 13.3 | 20.8 | −37.6 | 18.7 | 1.81 | 0.50 | 0.90 | 0.10 | 0.06 | 0.14 |
| 80 | 8 | 18.7 | 33.7 | −44.8 | 4.5 | 1.33 | 0.10 | 0.13 | 0.01 | 0.03 | 0.03 |
| 87 | 9 | 23.1 | −3.5 | 50.1 | −67 | 14.31 | 1.34 | 19.14 | 1.26 | 0.02 | 1.95 |

TABLE 2

Test results of medium strikes on circular pad, where strike locations range from the pad surface center to pad surface edge in Direction 1 as shown in FIG. 13.

| Medium Hit (End Stop 36 mm) | | | Test c | Peak | Peak | Peak | Peak | Peak | Standard Deviation | Standard Deviation | Standard Deviation |
|---|---|---|---|---|---|---|---|---|---|---|---|
| Direction 2 mm | Strike Position From Centre | Energy | Peak 1 Value | 2 Value | 3 Value | 2/1 Ratio | 3/2 Ratio | 3/1 Ratio | Peak 2/1 Ratio | Peak 3/2 Ratio | Peak 3/1 Ratio |
| 0 | 0 | 287 | −724 | 614 | −560 | 0.85 | 0.91 | 0.77 | 0.01 | 0.00 | 0.01 |
| 10 | 1 | 290 | −682 | 671 | −564 | 0.98 | 0.84 | 0.83 | 0.01 | 0.01 | 0.01 |
| 20 | 2 | 220 | −518 | 468 | −308 | 0.90 | 0.66 | 0.59 | 0.02 | 0.02 | 0.03 |
| 30 | 3 | 167 | −446 | 204 | −75 | 0.46 | 0.37 | 0.17 | 0.06 | 0.14 | 0.07 |
| 40 | 4 | 141 | 28 | −349 | 242 | 12.46 | 0.69 | 8.64 | 0.90 | 0.03 | 0.42 |
| 50 | 5 | 153 | 43 | −307 | 346 | 7.14 | 1.13 | 8.05 | 0.71 | 0.02 | 0.87 |
| 60 | 6 | 133 | 93 | −353 | 332 | 3.80 | 0.94 | 3.57 | 0.17 | 0.01 | 0.14 |
| 70 | 7 | 69 | 111 | −182 | 118 | 1.64 | 0.65 | 1.06 | 0.11 | 0.05 | 0.16 |
| 80 | 8 | 89 | −14 | 135 | −228 | 9.64 | 1.69 | 16.29 | 0.55 | 0.02 | 0.81 |
| 87 | 9 | 137 | −32 | 277 | −396 | 8.66 | 1.43 | 12.38 | 1.46 | 0.02 | 1.82 |

TABLE 3

Test results of hard strikes on circular pad, where strike locations range from the pad surface center to pad surface edge in Direction 1 as shown in FIG 13.

| Hard Hit (End Stop 20 mm) | | | Test c | Peak | Peak | Peak | Peak | Peak | Standard Deviation | Standard Deviation | Standard Deviation |
|---|---|---|---|---|---|---|---|---|---|---|---|
| Direction 2 mm | Strike Position From Centre | Energy | Peak 1 Value | 2 Value | 3 Value | 2/1 Ratio | 3/2 Ratio | 3/1 Ratio | Peak 2/1 Ratio | Peak 3/2 Ratio | Peak 3/1 Ratio |
| 0 | 0 | 2011 | −4560 | 3520 | −4510 | 0.77 | 1.28 | 0.99 | 0.04 | 0.04 | 0.02 |
| 10 | 1 | 1907 | −3870 | 4130 | −4370 | 1.07 | 1.06 | 1.13 | 0.14 | 0.04 | 0.01 |
| 20 | 2 | 1522 | −3130 | 3500 | −2760 | 1.12 | 0.79 | 0.88 | 0.00 | 0.01 | 0.02 |
| 30 | 3 | 1015 | −2460 | 1860 | −610 | 0.76 | 0.33 | 0.25 | 0.03 | 0.03 | 0.03 |
| 40 | 4 | 853 | 210 | −1930 | 1940 | 9.19 | 1.01 | 9.24 | 1.69 | 0.10 | 0.57 |
| 50 | 5 | 1027 | 370 | −1960 | 2560 | 5.30 | 1.31 | 6.92 | 0.15 | 0.02 | 0.28 |
| 60 | 6 | 842 | 600 | −2020 | 2030 | 3.37 | 1.00 | 3.38 | 0.17 | 0.01 | 0.17 |
| 70 | 7 | 326 | −60 | 620 | −830 | 10.33 | 1.34 | 13.83 | 0.33 | 0.07 | 0.58 |
| 80 | 8 | 822 | −180 | 1440 | −2210 | 8.00 | 1.53 | 12.28 | 0.67 | 0.02 | 1.10 |
| 87 | 9 | 405 | 170 | −380 | 760 | 2.24 | 2.00 | 4.47 | 0.55 | 1.67 | 1.24 |

Figure 12:
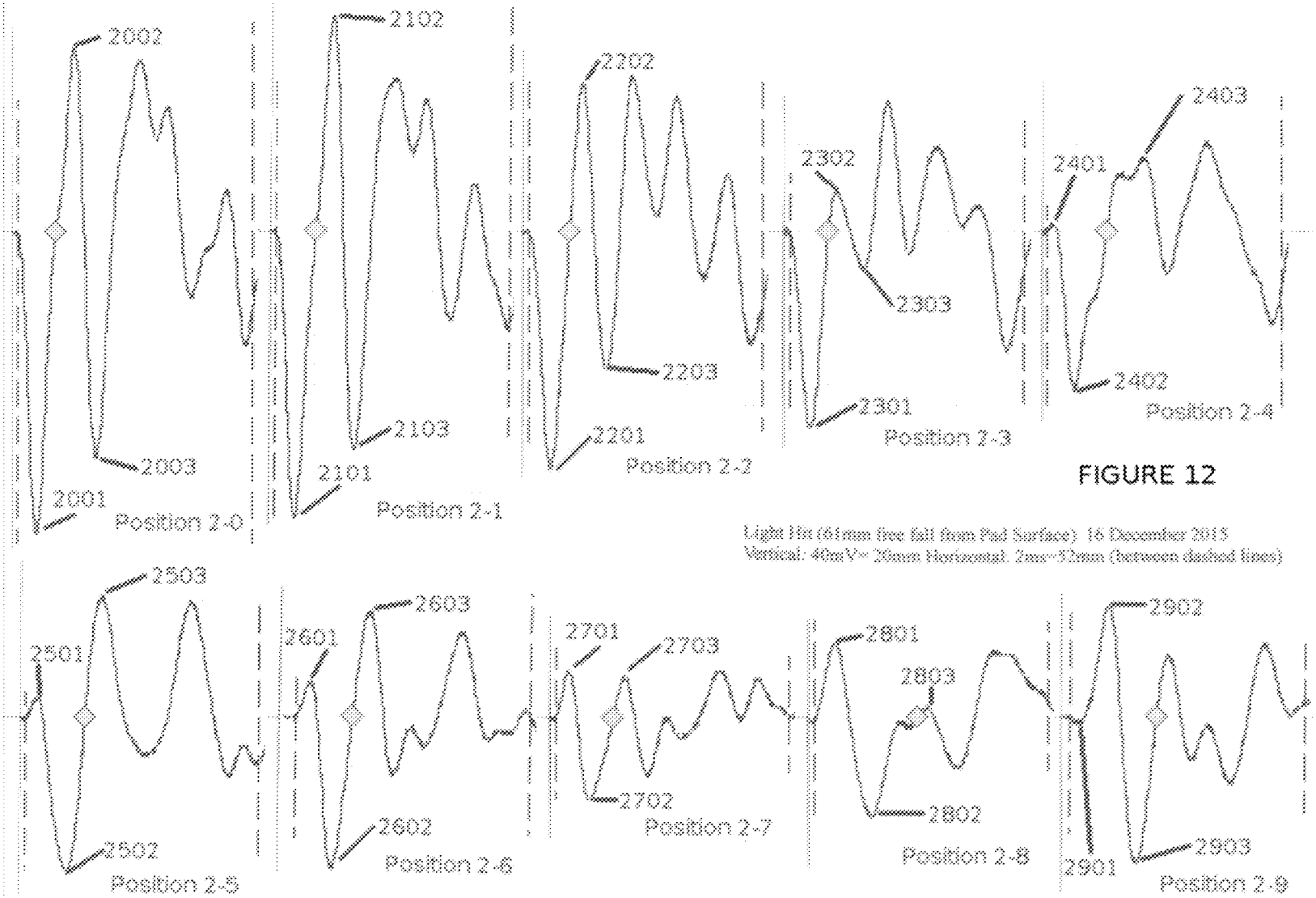
FIG. 12 shows 10 singular input signals each one of which corresponds to one 10 strike locations ranging from the center of the surface to the edge made with a drumstick with a wooden tip.

FIG. 12 is a graphical display of singular input signals corresponding to the test data in Table 1.

Every different position where the percussion surface is struck yields a different shaped signal or unique characteristic. How hard (intensity) of the strike also influences the shape or characteristic.

For the entries in labelled Energy of Tables 1-3, the rms (root mean square) energy of samples was calculated (summing the square of the samples in the sample length and then square rooting). These values give an indication whether the hit was light medium or hard intensity and which criteria and Table to use for position determination. Energy value differs significantly due to position, as shown in each table, so if position is determined a suitable scaling factor can be added to these energy values to normalise them, if preferred.

The signal analyser is configured to provide with a characteristic an estimation of the location of the strike as indicated by the characteristic.

In FIG. 12, ten singular input traces made by ten strikes are shown. Each singular input trace is recorded test data of a strike on the surface of the circular 'Roland PD8' percussion pad with the drumstick with the wood tip. The drumstick was dropped 61 mm in free fall in each of the ten strikes. So each strike was a soft strike.

The singular input trace labeled 'Position 2-0' was produced by a strike on the center of the circular surface. The singular input trace labeled 'Position 2-1' was produced by a strike 10 mm from the center in Direction 2 as shown in FIG. 13. The singular input trace labeled 'Position 2-2' was produced by a strike 20 mm from the center in Direction 2 as shown in FIG. 13. The singular input trace labeled 'Position 2-3' was produced by a strike 30 mm from the center in Direction 2 as shown in FIG. 13. At the strikes at positions '2-4', '2-5', '2-6', '2-7', '2-8', and '2-9' were 40 mm, 50 mm, 60 mm, 70 mm, 80 mm, and 87 mm from the center respectively in Direction 2 as shown in FIG. 13. It was no physically possible to strike the pad 90 mm from the centre so the closest was 87 mm from the centre. The radius of the circular surface was approximately 100 mm. The strike at 'Position 1-9' was approximately 13 mm from the circular edge of the pad.

Each singular input trace in FIG. 12 has crests and troughs.

The first trough in the singular input trace for the strike at 'Position 2-0' is labeled 2001. The first crest is labeled 2002. The second trough is labelled 2003.

The first trough in the singular input trace for the strike at 'Position 2-1' is labeled 2101. The first crest is labeled 2102. The second trough is labelled 2103.

At each successive position '2-2', '2-3', . . . '2-9', the first occurrence of a crest or trough is labelled 2201, 2301, . . . 2901 respectively. The second occurrence of a crest or trough is labelled 2202, 2302, . . . 2902 respectively. The third occurrence of a peak or trough is labelled 2203, 2303, . . . 2903 respectively.

The signal analyser is configured to detect each of the crests and troughs. The signal analyser is configured to detect the first crest or trough and determine whether it is a crest or a trough. Whether it is a crest or a trough is a characteristic of the strike on the surface.

In FIG. 12 it can be seen that where the percussion surface is struck at the center, a trough 2001 occurs before any crest. Where the percussion pad is struck anywhere from the center up to 40 mm from the center, a trough 2001 occurs before any crest.

It can also be seen in FIG. 12 that the relative magnitude of the second trough 2003 is greatest for a strike at the center and gets progressively smaller for a strike further away from the center until the first peak changes polarity.

FIG. 12 can be used in conjunction with table 1 to determine position.

Table 1 shows the amplitude of crests and troughs of the soft strikes in FIG. 12. The first column indicates the distance of the strike from the center of the pad.

The amplitude of the first three crests and troughs are in columns labelled peak 1, peak 2, and peak 3. Peak 1 is the first crest or trough in the single input signal. Peak 2 is the crest or trough immediately following peak 1. Peak 3 is the crest or trough immediately following peak 2.

Peak ratios are absolute ratios of peak values in the examples shown to simplify the maths but need not be. For example Peak 2/1 ratio for position 2-0 Light Hit is 85.2 divided by −139.4=0.61 (always positive for absolute)

For a soft strike on the center of the percussion surface, the amplitude of the first tough 2001 is recorded in the column of peak 1 as −139. The amplitude of the first crest 2002 is recorded in the column of peak 2 as 85.2. The amplitude of the second trough 2003 is recorded in the column of peak 3 as −104.5.

In Tables 1, 2, and 3 and for the first peak "peak 1", the peaks of the troughs have a negative amplitude, and the peaks of the crests have a positive amplitude. The signal analyser is configured to determine that successive peaks of positive amplitude are generally crests but maybe troughs and vice versa successive peaks of negative amplitude are generally troughs but maybe crests. There are instances where the first 3 peaks are either all negative or all positive and these quite unusual instances do give a determined position on the percussion surface that the hit occurred.

To determine position for light hits (see FIG. 12 and table 1) the signal analyser is configured to determine the energy of the signal to determine whether the percussion pad has been struck lightly, of a medium intensity or hard. If the energy is less than 50 then in table 1 and then determined to be a light hit. The signal analyser is configured to determine, from tables 1-3 to set out the criteria to follow in determining the distance from the center of the percussion pad, where the pad was struck.

The signal analyser is configured to determine where a trough occurs before any crest. In FIG. 12 and table 1, an initial trough (Peak 1 negative) determines a hit at position 2-0, 2-1, 2-2, 2-3 or 2-9. A Peak 2/1 ratio above 7 determines a position near the edge 2-9. If Peak 2/1 less than 7 use Peak 3/2 ratio 1.23, 1.0, 0.91 or 0.86 to determine positions 2-0, 2-1, 2-2 or 2-3. If Peak 1 positive (if crest occurs before a trough) determines a hit 2-4, 2-5, 2-6, 2-7 and 2-8. Use Peak 2/1 ratio 19.08, 8.09, 4.37, 1.81 or 1.33 to determine 2-4, 2-5, 2-6, 2-7 or 2-8.

To determine position for medium hits see Table 2 the signal analyser is configured to determine the energy of the signal to determine whether the percussion pad has been struck lightly, of a medium intensity or hard. If the energy is between 69 and 290 then in table 2 determined to be a medium hit. The signal analyser is configured to determine, from tables 1-3 to set out the criteria to follow in determining the distance from the center the percussion pad, where the pad was struck.

The signal analyser is configured to determine where a trough occurs before any crest (Peak 1 positive or negative). In FIG. 12 and table 2, an initial trough (Peak 1 negative) determines a hit at position 2-0, 2-1, 2-2, 2-3, 2-8 or 2-9. A Peak 2/1 ratio above 7 determines a position near the edge of 2-8 or 2-9. If Peak 3/1 ratio 16.29 the position 2-8 and if Peak 3/1 ratio 12.38 then position 2-9. If Peak 2/1 ratio less than 7 use Peak 3/2 ratio 0.91, 0.84, 0.66 or 0.37 to determine positions 2-0, 2-1, 2-2 or 2-3. If Peak 1 positive (if crest occurs before a trough) determines a hit 2-4, 2-5, 2-6 or 2-7. Use Peak 2/1 ratio, 12.46, 7.14, 3.8 or 1.64 to determine 2-4, 2-5, 2-6 or 2-7.

To determine position for hard hits see Table 3.

The signal analyser is configured to determine the energy of the signal to determine whether the percussion pad has been struck lightly, of a medium intensity or hard. If the energy is between 405 and 2011 then in table 3 and determined a hard hit. The signal analyser is configured to determine the table to use shown in tables 1-3 to set out the criteria to follow in determining the distance from the center the percussion pad.

The signal analyser is configured to determine where a trough occurs before any crest (Peak 1 positive or negative). In FIG. 12 and table 2, an initial trough (Peak 1 negative) determines a hit at position 2-0, 2-1, 2-2, 2-3, 2-7 and 2-8. A Peak 2/1 ratio above 7 determines a position near the edge of 2-7 or 2-8. If Peak 3/1 ratio 13.83 the position 2-7 and if Peak 3/1 ratio 12.28 then position 2-8. If Peak 2/1 ratio less than 7 use Peak 3/2 ratio 1.28 1.06 0.79 0.33 to determine positions 2-0, 2-1, 2-2, 2-3. If Peak 1 positive (if crest occurs before a trough) determines a hit between 2-4 2-5 2-6 and 2-9. Use Peak 2/1 ratio, 9.19 5.3 3.37 2.24 to determine 2-4 2-5 2-6 and 2-9.

For convenience have shown how to calculate for a discrete for a set of results for a light medium and hard hit. For hits that fall between these intensities of hits use interpolation to determine peak ratios to determine position. Using more than three sets of results (light medium and hard) for example ppp, pp, p, mf, f, ff, and fff in musical notation can be utilised to increase accuracy.

In an alternative embodiment which is not shown by FIG. 12 or in Table 1, Table 2, or Table 3, the polarity of the electrical wire 16 which connects the vibration sensor 14 to the signal processor 100 is reversed. The signal analyser is configured to compensate for the reversed polarity.

The magnitude of the first trough is a characteristic of the singular input signal from which the signal analyser is arranged to provide an indication of the location of the strike. In one embodiment the signal analyser is configured to estimate the strike location based on a correlation the of decrease in the relative magnitude of the first trough with distance of the strike from the center of the percussion surface. In another embodiment the signal analyser is configured with a table of data which includes the relative magnitude of the first tough of strikes at distances of 0 mm, 10 mm, 20 mm, 30 mm and 40 mm from the center as shown in Table 1 column of peak 1 amplitude. The signal analyser is arranged compare the relative magnitude of the first trough in a singular input signal and to the table data to estimate the location of the strike.

As shown in Table 1, the peak 1 amplitude of the singular input signal increases as the location of the strike moves away from the center of the percussion surface. The amplitude is at a minimum of −139 where the strike is on the center of the percussion surface. The amplitude is at maximum of +33 where the strike near the edge of the percussion surface. Only at the edge need to determine an edge hit by a different determination as described elsewhere. In one embodiment the signal analyser is configured with a means to estimate the location of a strike using the relationship of relative increasing peak 1 amplitude as the strike moves away from center. In another embodiment the signal analyser is configured with data pairs of peak 1 relative amplitude and strike location. The signal analyser is configured to compare a single input signal peak 1 relative amplitude to the data pairs to provide an indication of the strike location.

The signal analyser is a simple and low cost device configured to find the first peak in a singular input signal and make an estimation based on a trend or by comparison to data pairs in a table configured into the signal analyser. The signal analyser provides an estimate of the strike location very quickly since no complex calculations are required to simply compare a peak 1 relative value in a single input signal to a simple trend or to simple pairs of data. The signal processor is arranged to determine the characteristic and provide a command signal within 2 to 3 milliseconds.

FIG. 12 shows that where the strike is near to the edge of the percussion surface, the first crest is 2902 by a strike 13 mm from the edge shown for position 2-9. The further the strike from the edge, the lower relative amplitude of the crest. This can be seen in FIG. 12 by crest 2902, 2801, crest 2701, crest 2601, crest 2501 and crest 2401 which are by strikes 13 mm, 23 mm, 33 mm, 43 mm, 53 mm and 63 mm from the percussion surface edge respectively.

Table 1 shows that amplitude of crest 2902, crest 2801, crest 2701, crest 2601, crest 2501 and crest 2401 decreases from a maximum value of 50.1, 33.7, 20.8, 15.8, 8.8 and 3.8 respectively. The signal analyser is configured to determine the distance of a strike from the edge of the surface from a characteristic which is amplitude of a first crest which occurs in a signal input signal.

Table 1 also shows ratio of the magnitudes of the amplitudes of the first three peaks in single input signal. The signal analyser is configured determine the amplitude of the first three peaks in a single input signal and compute the ratio of the magnitudes of the amplitudes as shown in Table 1.

The column labeled 'peak 2/1 ratio' is the absolute ratio of the magnitude of the second peak (peak 2) to that of the first peak (peak 1). The column labelled 'peak 3/2 ratio' is the absolute ratio of the magnitude of the third peak (peak 3) to that of the second peak (peak 2). The column labelled 'peak 3/1 ratio' is the absolute ratio of the magnitude of the third peak (peak 3) to that of the first peak (peak 1).

The polarity of the connection of the electrical wire 16 which connects the vibration sensor 14 to the signal processor does not affect an absolute ratio of peak magnitude of amplitudes at a characteristic, since magnitude is unaffected by polarity. In embodiments where the signal analyser is configured to determine a characteristic from an absolute peak ratio, the configuration of the signal analyser is simplified since it is not configured to compensate for polarity. Connections by which the electrical wire 16 connects the vibration sensor 14 to the signal processor is also simplified since the connection does not require a means to insure proper polarity of the connections. In some embodiments the signal analyser is configured to first determine a characteristic indicating the percussion surface has been given a soft strike and then use the peak 2/1 ratio to determine the distance of the strike from the center. Table 1 shows the peak 2/1 ratio decreases with distance from the center for strikes up to 30 mm from the center.

In some embodiments the signal analyser is configured to determine whether peak 1 is negative (a trough) and the peak 2/1 ratio characteristic is less than 2, because in this case the peak ratio 2/1 is useful characteristic for estimating location of a strike. Table 1, Table 2, and Table 3 indicate the strike was approximately 30 mm from the center whether the peak strike was soft, medium or hard. The peak 3/2 ratio provide another characteristic to interpolate between data values in the tables.

In some embodiments the signal analyser is configured to determine whether peak 1 is negative (a trough) and the peak 2/1 ratio is more than 2, because for this singular input signal the peak 2/1 ratio is a useful characteristic for estimating location of a strike in cases where the strike has first been determined to be a soft strike, a medium strike, or a hard strike. In this case the signal analyser is configured to determine that the strike was located about 13 mm from edge (position 2-9 in FIG. 12, position 9 in Table 1, Table 2, and Table 3) for a soft strike. The signal analyser is configured to determine the strike was located in position 8 to 9 for medium hits using data such as in Table 2, and in position 7 to 8 for a hard strike using data such as in Table 3.

In some embodiments the signal analyser is configured to determine for a singular input signal having a positive peak 1 amplitude and a peak 3/2 ratio less than 2 that the strike occurred on the percussion surface in position 4 to 8 for a soft strike, in position 4 to 7 for a medium strike, and position 4 to 6 for a hard strike. For soft, medium, and hard strikes, Tables 1, 2, and 3 show that peak ratios 2/1 and 3/1 are usable by signal analyser to interpolate a strike location.

A strike on the circular surface of a percussion pad produces a singular input signal with characteristics which indicate the direction as well as the distance of the strike from the center of the surface.

Figure 14:
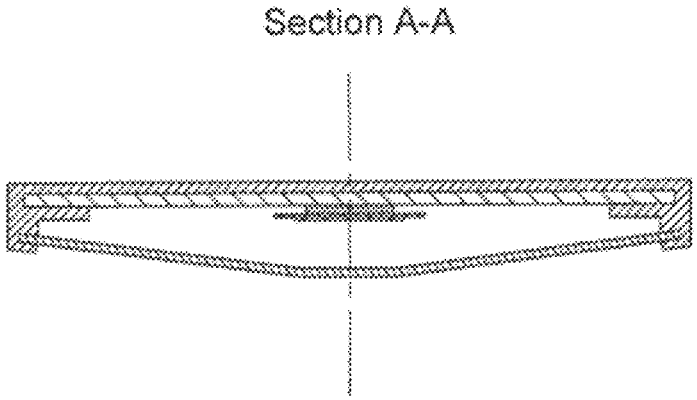
FIG. 14 shows side view of the percussion pad having the percussion surface where the wooden tip of the drumstick struck to produce the singular input signals of FIG. 12.
Figure 15:
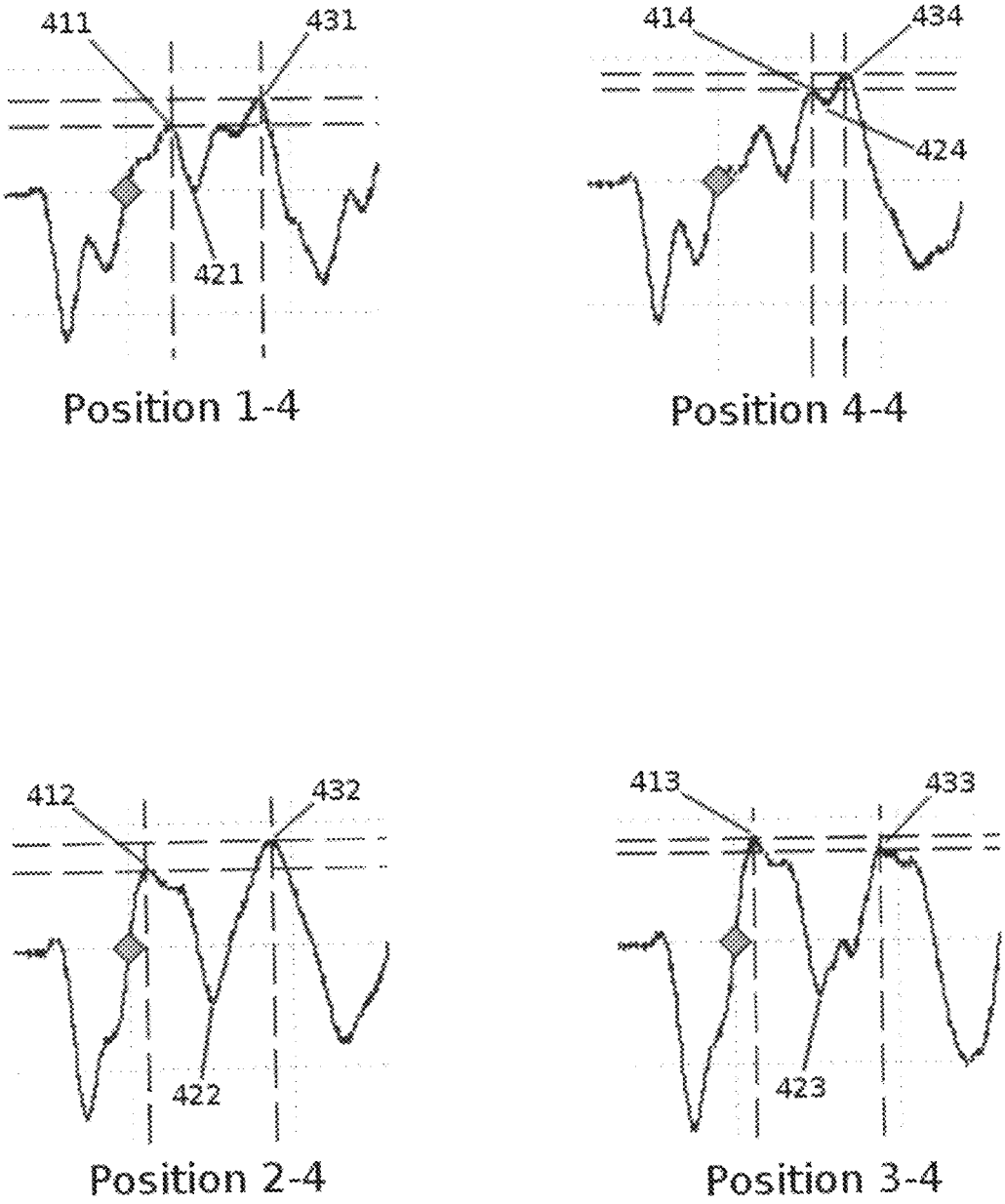
FIG. 15 shows 4 singular input signals in 4 quadrants of on the circular percussion surface of the percussion pad illustrated in FIGS. 13 and 14.

FIG. 15 shows an input signal for each strike at 4 positions the surface of the circular pad shown in FIGS. 13 and 14. Each strike is a soft strike of equal intensity.

Locations of the strikes at the 4 positions 1-4, 2-4, 3-4, and 4-4 are located the same distance from the center of the surface. Position 1-4 is 40 mm from the center and 0 degrees from theoretical reference axis. The direction of 0 degrees being in direction 1 of FIG. 13. Position 4-4 is 40 mm and 90 degrees from the center, position 2-4 is 40 mm and 180 degrees from the center; and position 3-4 is 40 mm and 270 degrees from the center.

FIG. 15 shows the input signals at each of the 4 positions have a pair crests of greatest magnitude. The first of the two crests is labeled 411, 412, 413, and 414 at positions 1-4, 2-4, 3-4, and 4-4 respectively. The subsequent of the two crests is labelled 431, 432, 433, and 434. Between each pair of crests are troughs labeled 421, 422, 423, and 424 for each respective pair.

Numerical values for each of the troughs and crests labelled in FIG. 15 are given Table 4.

TABLE 4

Test results of soft strikes on circular pad, where strike locations are equidistant from the center and in four directions each 90 degrees apart.

| Position | Peak 1 (mV) | Peak 2 (mV) | Peak 3 (mV) | Ratio 3/1 | Elapsed Time between Peak 1 & 3 (microSec) |
|---|---|---|---|---|---|
| 1-4 | 21.7 | 0.3 | 30.2 | 1.39 | 551 |
| 2-4 | 25.2 | −17.6 | 34.5 | 1.37 | 772 |
| 3-4 | 33.3 | −26.1 | 29.6 | 0.89 | 780 |
| 4-4 | 29.1 | 27.0 | 34.7 | 1.19 | 199 |

The numerical value of the first crests 411, 412, 413, and 414 are given under the column labelled peak 1 according to the position of the strike shown in the left most column of Table 4. The numerical values of troughs 421, 422, 423, and 424 are given under the column labelled peak 2. The numerical values of the subsequent crests 431, 432, 433, and 434 are given under the column labelled peak 4. The ratio of peak 3 divided by peak 1 are given under the column labelled ratio 3/1. The time interval between the first and subsequent crest is given in the final column.

The direction to the strike location on the percussion pad is determinable from the relative numerical values of the crests and troughs and from their ratios and from the time intervals between them. The relative numerical values, ratios and time intervals are characteristics of the singular input signals are indicative of the direction to the strike. This is surprising because as can be seen in FIG. 13 the percussion pad has a circular surface. Each strike is the same distance of 40 mm from the center. The vibration sensor is located at the center. Consequently, it would be expected that the crest and trough numerical values would be the same for strikes on locations in all directions equidistant from the center.

The signal processor is arranged to determine the characteristics of the input signals indicative of the direction of the strike. It determines the direction from the values of the crests and troughs, the ratios of the crest and trough values, and the time between the crests and troughs.

The invention has been described by way of examples only. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the claims.

What is claimed is:

1. A signal processor for a percussion instrument, comprising:

a singular input signal acquiring means to acquire a singular input signal via a reversible polarity connection to a vibration sensor arranged to detect a physical vibration of a percussion surface over time;

a signal analyser to analyse the input signal for a characteristic of a strike on the surface which caused the vibration;

an extrema detector to determine an occurrence of a trough or crest in the signal;

a ratio computer to determine a ratio of the magnitude of an occurrence of a trough or crest to the magnitude of a successive crest and/or trough in the input signal; and wherein the signal analyser is configured to determine from the ratio the strike location as a distance from a reference point on the surface to strike; and a command signal providing means to provide a command signal that indicates the location according to the characteristic.

2. The signal processor according to claim 1, wherein:

the extrema detector is arranged to detect a minor trough defined as the first peak in the signal after the strike and determine whether the magnitude of the minor trough is less than the magnitude of the subsequent trough or crest in the signal; and the command signal indicates an edge of the surface closest to the location of the strike.

3. The signal processor according to claim 1, comprising:

an elapsed time detector to determine the characteristic with an interval between a trough and/or a crest in the input signal, or between the start of the signal and a trough or crest.

4. The signal processor according to claim 1, comprising:

a crest and/or trough counter to count peaks and/or troughs in the signal to determine the characteristic.

5. The signal processor according to claim 1, comprising:

a slope detector to determine the characteristic with a rate of change in the signal over time.

6. The signal processor according to claim 1, comprising:

a signal energy determiner to determine an energy of the input signal so as to determine the energy of impact of the strike.

7. The signal processor according to claim 1, wherein the command signal indicates an angle toward the strike with respect to a reference axis.

8. A percussion instrument, comprising:

a percussion pad having a top surface which is a percussion surface;

a single vibration sensor fixed to a singular location of the pad;

an electrical connection of reversible polarity between the vibration sensor and a signal processor to carry a singular input signal from the vibration sensor to the signal processor;

the signal processor comprising:

a signal analyser to analyse the input signal for a characteristic of a strike on the surface which caused the vibration;

an extrema detector to determine an occurrence of a trough or crest in the signal;

a ratio computer to determine a ratio of the magnitude of an occurrence of a trough or crest to the magnitude of a successive crest and/or trough in the input signal and wherein the signal analyzer is configured to determine from the ratio the strike location as a distance from a reference point on the surface to the strike; and a command signal providing means to provide a command signal that indicates the location a distance according to the characteristic.

9. The percussion instrument according to claim 8, wherein the percussion pad comprises a rectangular block, and the signal processor is arranged to determine the location of a strike along the length.

10. The percussion instrument according to claim 9, wherein the vibration sensor is a piezo-electric vibration sensor located mid-width and offset from the center of the longest dimension.

11. The percussion instrument according to claim 8, comprising a circular pad comprising the percussion surface.

12. The percussion instrument according to claim 11, wherein the vibration sensor comprises a piezo-electric sensor arranged at the center of the surface.

* * * * *